US011821648B2

(12) United States Patent
Yu et al.

(10) Patent No.: US 11,821,648 B2
(45) Date of Patent: Nov. 21, 2023

(54) AIR SWEEPING MECHANISM AND AIR CONDITIONER WITH AIR SWEEPING MECHANISM

(71) Applicant: Gree Electric Appliances, Inc. of Zhuhai, Guangdong (CN)

(72) Inventors: Jiebin Yu, Guangdong (CN); Han Liu, Guangdong (CN); Junhong Wu, Guangdong (CN); Xu Gao, Guangdong (CN)

(73) Assignee: Gree Electric Appliances, Inc. of Zhuhai, Zhuhai (CN)

( * ) Notice: Subject to any disclaimer, the term of this patent is extended or adjusted under 35 U.S.C. 154(b) by 156 days.

(21) Appl. No.: 16/960,768

(22) PCT Filed: Dec. 3, 2018

(86) PCT No.: PCT/CN2018/118960
§ 371 (c)(1),
(2) Date: Jul. 8, 2020

(87) PCT Pub. No.: WO2019/134472
PCT Pub. Date: Jul. 11, 2019

(65) Prior Publication Data

US 2020/0400342 A1 Dec. 24, 2020

(30) Foreign Application Priority Data

Jan. 8, 2018 (CN) ..... 201810015384.2

(51) Int. Cl.
*F24F 13/15* (2006.01)
*F24F 13/14* (2006.01)

(52) U.S. Cl.
CPC ..... *F24F 13/15* (2013.01); *F24F 13/1426* (2013.01); *F24F 13/1486* (2013.01); *F24F 2013/1433* (2013.01)

(58) Field of Classification Search
CPC .... F24F 13/15; F24F 13/1426; F24F 13/1486; F24F 2013/1433; F24F 2013/1493; F24F 13/14; Y10T 16/525; B29L 2031/22
(Continued)

(56) References Cited

U.S. PATENT DOCUMENTS 6,355,335 B1 * 3/2002 Kulkaski ..... B29C 48/12 16/225
2002/0175305 A1 * 11/2002 McCabe
2013/0029583 A1 1/2013 Zhang et al.

FOREIGN PATENT DOCUMENTS

CN 202 267 188 U 6/2012
CN 203 375 644 U 1/2014
(Continued)

OTHER PUBLICATIONS

English Translation of CN203980590U, dated Jan. 27, 2022 (Year: 2022).*
(Continued)

*Primary Examiner* — Edelmira Bosques
*Assistant Examiner* — Brett Peterson Mallon
(74) *Attorney, Agent, or Firm* — McAndrews, Held & Malloy, Ltd.

(57) ABSTRACT

The disclosure discloses an air sweeping mechanism and an air conditioner with the air sweeping mechanism. The air sweeping mechanism includes: a mounting portion, the mounting portion being configured to be mounted on a housing of the air conditioner; an air sweeping blade, the air sweeping blade being connected with the mounting portion; and a driving rod, the driving rod being connected with the air sweeping blade, and a position of the driving rod being adjustably disposed, wherein the air sweeping blade and the driving rod are integrally formed, at least part of the air
(Continued)

sweeping blade is a flexible portion, and the driving rod drives the at least part of the air sweeping blade to move.

15 Claims, 4 Drawing Sheets

(58) Field of Classification Search
USPC ..... 16/221–392; 454/320
See application file for complete search history.

(56) References Cited

FOREIGN PATENT DOCUMENTS

| | | | | |
|---|---|---|---|---|
| CN | 203454360 | U | | 2/2014 |
| CN | 104101070 | A | | 10/2014 |
| CN | 203 980 590 | U | | 12/2014 |
| CN | 104236043 | A | * | 12/2014 |
| CN | 203980590 | U | * | 12/2014 |
| CN | 203980590 | U | | 12/2014 |
| CN | 204718056 | U | | 10/2015 |
| CN | 204718056 | U | * | 10/2015 |
| CN | 105371466 | A | | 3/2016 |
| CN | 105371466 | A | * | 3/2016 |
| CN | 107 525 250 | A | | 12/2017 |
| CN | 108131813 | A | | 6/2018 |
| EP | 3 187 792 | A1 | | 7/2017 |
| EP | 3187792 | A1 | * | 7/2017 |
| JP | H09113025 | A | | 5/1997 |
| JP | H10141754 | A | | 5/1998 |

OTHER PUBLICATIONS

English Translation of CN104236043A, dated Nov. 25, 2022 (Year: 2022).*

English Translation of CN204718056U, dated Jan. 27, 2022 (Year: 2022).*

English Translation of CN105371466A, dated Jan. 27, 2022 (Year: 2022).*

International Search Report, dated Feb. 25, 2019, in International application No. PCT/CN2018/118960, filed on Dec. 3, 2018.

The extended European search report for Application No. 18898368.8, dated Sep. 6, 2021, European Patent Office, Germany (9 pages).

* cited by examiner

AIR SWEEPING MECHANISM AND AIR CONDITIONER WITH AIR SWEEPING MECHANISM

CROSS REFERENCE TO RELATED APPLICATIONS

The present disclosure is a national stage application of International Patent application No. PCT/CN2018/118960, which was filed Dec. 3, 2018, and claims priority to Chinese Patent Application No. 201810015384.2, filed Jan. 8, 2018, entitled "Air Sweeping Mechanism and Air Conditioner Having Same," the contents of which are hereby incorporated by reference in its entirety.

TECHNICAL FIELD

The disclosure relates to a field of air conditioners, and in particular to an air sweeping mechanism and an air conditioner with the air sweeping mechanism.

BACKGROUND

Most of sweeping mechanisms of air conditioners known to inventors adopt traditional movement mechanisms, for example: a planar four-rod mechanism. These mechanisms are connected to each part by a movement pair to form a set of movement parts, but the assembly efficiency of such a mechanism is low.

SUMMARY

An embodiment of the disclosure provides an air sweeping mechanism and an air conditioner with the air sweeping mechanism, so as to solve a problem in an art known to inventors that the assembly efficiency of the air sweeping mechanism is lower.

Some embodiments of the present disclosure provide an air sweeping mechanism, which includes: a mounting portion, the mounting portion being configured to be mounted on a housing of the air conditioner; an air sweeping blade, the air sweeping blade being connected with the mounting portion; and a driving rod, the driving rod being connected with the air sweeping blade, and a position of the driving rod being adjustably disposed, wherein the air sweeping blade and the driving rod are integrally formed, at least part of the air sweeping blade is a flexible portion, and the driving rod drives the at least part of the air sweeping blade to move.

In an exemplary embodiment, the driving rod and the air sweeping blade are integrally injection-formed.

In an exemplary embodiment, the mounting portion, the air sweeping blade and the driving rod are integrally formed.

In an exemplary embodiment, the mounting portion, the air sweeping blade and the driving rod are integrally injection-formed.

In an exemplary embodiment, the air sweeping blades include a first connecting portion, the first connecting portion is connected with the driving rod, and the first connecting portion is a flexible portion.

In an exemplary embodiment, the first connecting portion is a flexible hinge.

In an exemplary embodiment, the first connecting portion is positioned at one end, away from the mounting portion, of the air sweeping blade; or the first connecting portion is positioned in a middle of the air sweeping blade.

In an exemplary embodiment, the air sweeping blades include a second connecting portion, the second connecting portion is connected with the mounting portion, at least part, close to the second connecting portion, of the air sweeping blade is a flexible portion, so that the air sweeping blade is moveably disposed relative to the mounting portion.

In an exemplary embodiment, at least part, close to the second connecting portion, of each of the air sweeping blades is a flexible hinge.

In an exemplary embodiment, the driving rod includes: a fixing portion, the fixing portion being connected with the air sweeping blade, at least part of the fixing portion being extended along a length direction of the mounting portion; and a driving portion, the driving portion being connected with one end of the fixing portion, and a position of the driving portion being adjustably disposed, so as to drive the fixing portion to move.

In an exemplary embodiment, the driving portion includes: a first driving section, the first driving section being provided with a passing hole, the passing hole being configured to be connected with a rotation shaft of a driving motor; and a second driving section, a first end of the second driving section being connected with the first driving section, and a second end of the second driving section being connected with the fixing portion, wherein, at least part of the second driving section is a flexible portion.

In an exemplary embodiment, the second driving section is a flexible hinge.

In an exemplary embodiment, the second driving section includes: a first stretching section, a first end of the first stretching section being connected with the first driving section, and a second end of the first stretching section being connected with the fixing portion; a second stretching section, a first end of the second stretching section being connected with the first driving section, and a second end of the second stretching section being connected with the fixing portion, wherein, at least part of the first stretching section is a flexible portion, and at least part of the second stretching section is a flexible portion.

In an exemplary embodiment, the second end of the first stretching section and the second end of the second stretching section are spaced from each other, and an avoidance cavity is formed between the first stretching section, the second stretching section, the fixing portion and the first driving section.

In an exemplary embodiment, the rotation shaft of the driving motor is clockwise and counterclockwise rotated, herein, a clockwise angle and a counterclockwise angle are less than or equal to 90 degrees.

An embodiment of the present disclosure provides an air conditioner, which includes an air sweeping mechanism, the air sweeping mechanism is the above air sweeping mechanism.

The air sweeping mechanism of the disclosure is disposed through enabling the air sweeping blades and the driving rod to be integrally formed, in a specific assembling process, the air sweeping blade is connected with the mounting portion, and then the mounting portion is installed on a housing of the air conditioner, so that the installation of the air sweeping mechanism is completed. The air sweeping mechanism of the disclosure is disposed through enabling the air sweeping blade and the driving rod to be integrally formed, installing steps of the air sweeping blade and the driving rod are eliminated, and the assembly efficiency of the air sweeping mechanism is improved in a certain degree, thereby the problem in the art known to inventors that the assembly efficiency of the air sweeping mechanism is lower is solved.

BRIEF DESCRIPTION OF THE DRAWINGS

The accompanying drawings formed into a part of the disclosure are described here to provide a further understanding of the disclosure. The schematic embodiments and description of the disclosure are adopted to explain the disclosure, and do not form improper limits to the disclosure. In the drawings.

The drawings include the following reference signs:

10. mounting portion; 20. air sweeping blade; 21. first connecting portion; 22. second connecting portion; 30. driving rod; 31. fixing portion; 32. driving portion; 321. first driving section; 3211. passing hole; 322. second driving section; 3221. first stretching section; 3222. second stretching section; 40. driving motor; and 50. housing.

DETAILED DESCRIPTION OF THE EMBODIMENTS

It is to be noted that the embodiments of the disclosure and the features of the embodiments are combined with each other if there is no conflict. The disclosure is described below in detail with reference to the accompanying drawings and in combination with the embodiments.

It is to be noted that the following detailed description is illustrative and is intended to provide further illustration for the disclosure. Unless otherwise specified, all technical and scientific terms used in the specification have the same meaning generally understood by the person skilled in the art of the disclosure.

It is to be noted that terms used herein only aim to describe specific implementation manners, and are not intended to limit exemplar implementations of this disclosure. As used herein, unless otherwise directed by the context, singular forms of terms are intended to include plural forms. Besides, it will be also appreciated that when terms "contain" and/or "include" are used in the description, it is indicated that features, steps, operations, devices, assemblies and/or a combination thereof exist.

Figure 1:
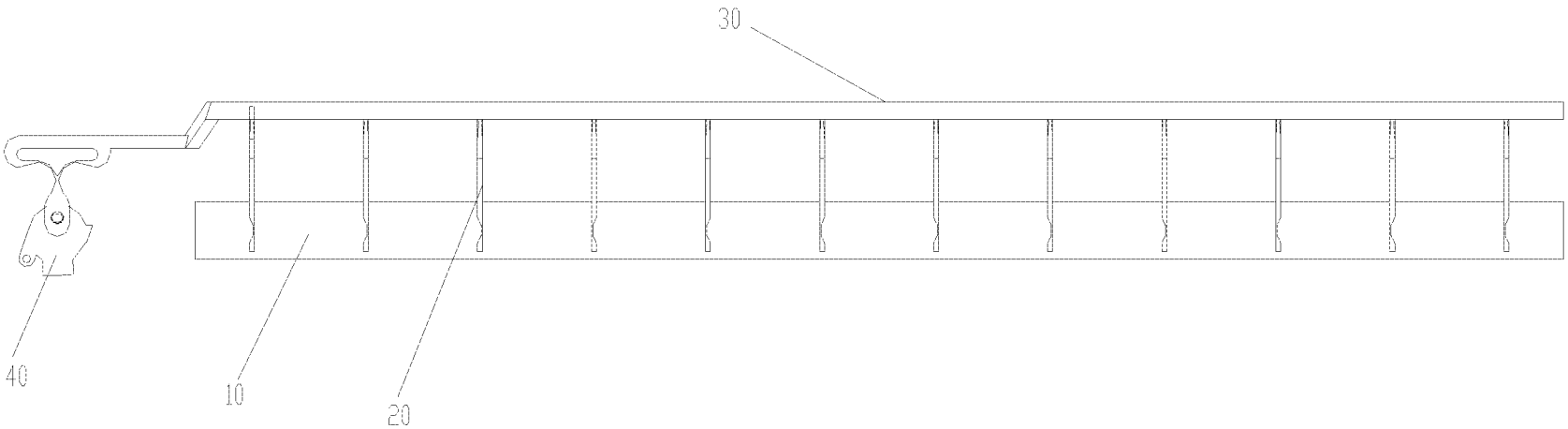
FIG. 1 illustrates a structure schematic diagram of a first viewing angel of an air sweeping mechanism according to the disclosure.
Figure 2:
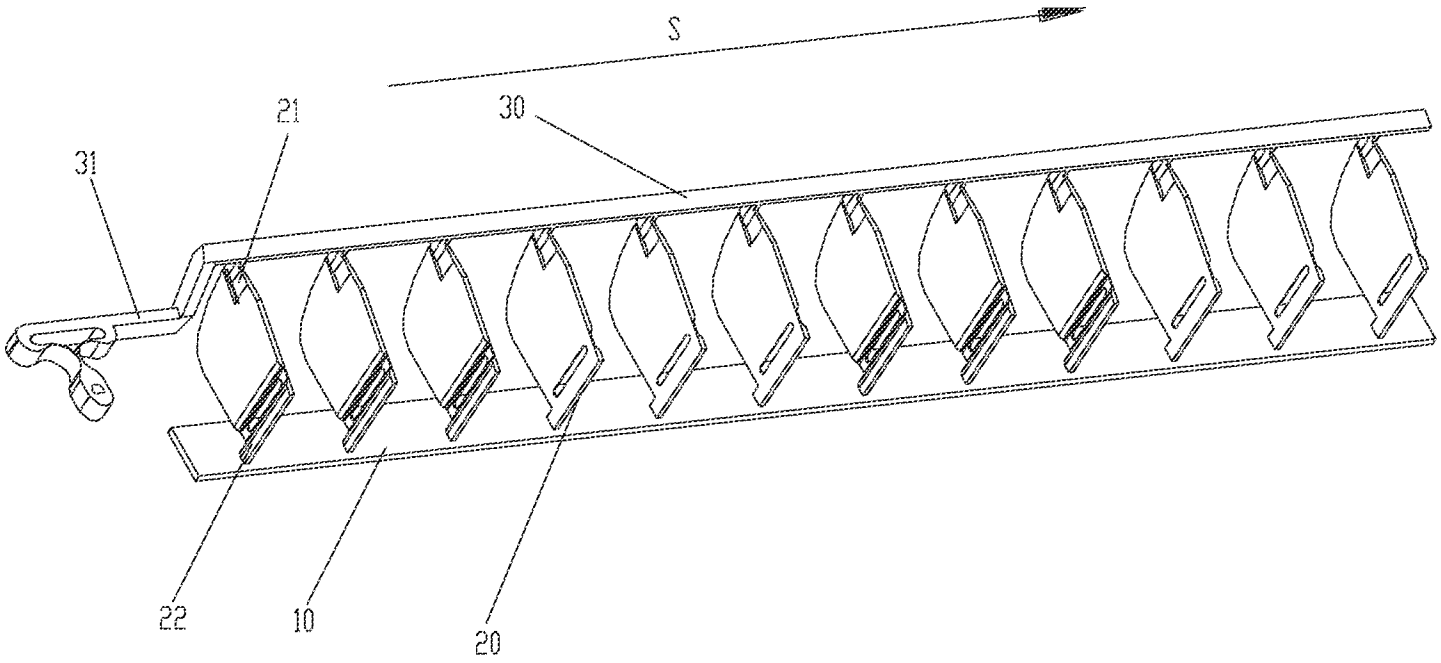
FIG. 2 illustrates a structure schematic diagram of a second viewing angel of the air sweeping mechanism according to the disclosure.
Figure 6:
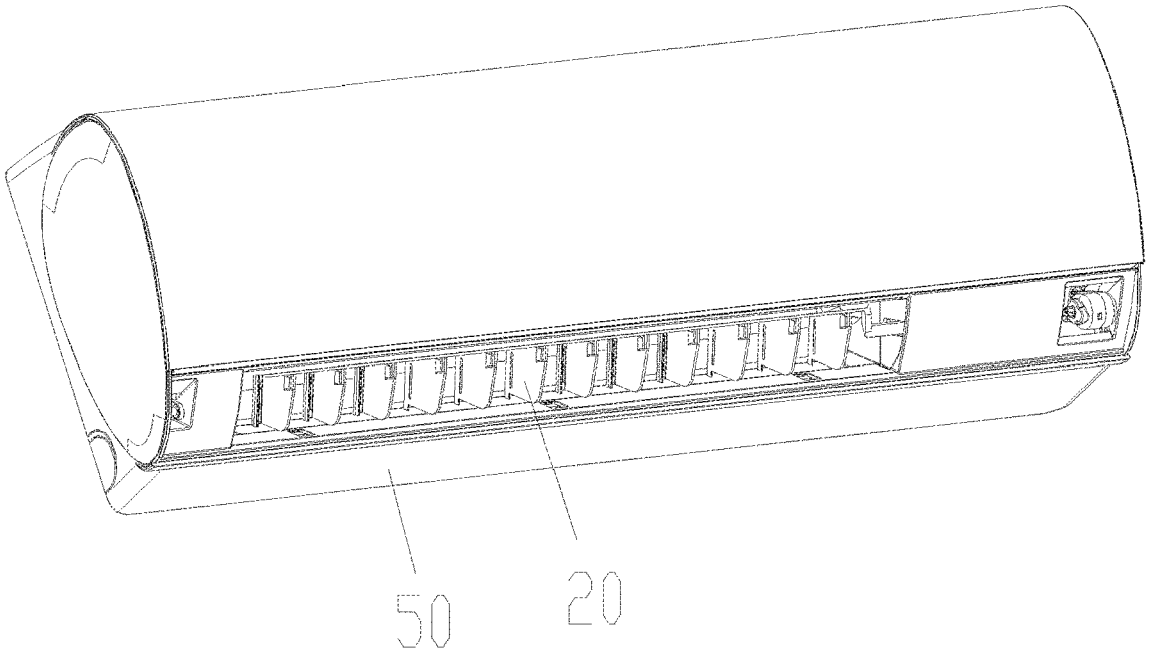
FIG. 6 illustrates a structure schematic diagram of an air conditioner according to an embodiment of the disclosure.

Some embodiments of the disclosure provide an air sweeping mechanism, reference to FIG. 1, FIG. 2, and FIG. 6, the air sweeping mechanism includes a mounting portion 10, an air sweeping blade 20 and a driving rod 30, wherein the mounting portion 10 is configured to be mounted on a housing 50 of an air conditioner, the air sweeping blade 20 is connected with the mounting portion 10, the driving rod 30 is connected with the air sweeping blade 20, and a position of the driving rod 30 is adjustably disposed, wherein the air sweeping blade 20 and the driving rod 30 are integrally formed, at least part of the air sweeping blade 20 is a flexible portion, and the driving rod 30 drives the at least part of the air sweeping blade 20 to move.

The air sweeping mechanism of an embodiment of the disclosure is disposed through enabling the air sweeping blade 20 and the driving rod 30 to be integrally formed, in a specific assembling process, the air sweeping blade 20 is connected with the mounting portion 10, and then the mounting portion 10 is installed on the housing 50 of the air conditioner, so that the installation of the air sweeping mechanism is completed. The air sweeping mechanism of an embodiment of the disclosure is disposed through enabling the air sweeping blade 20 and the driving rod 30 to be integrally formed, installing steps of the air sweeping blade 20 and the driving rod 30 are eliminated, and the assembly efficiency of the air sweeping mechanism is improved in a certain degree, thereby a problem in the technology known to inventors that the assembly efficiency of the air sweeping mechanism is lower is solved.

In some embodiments, through enabling at least part of the air sweeping blade 20 to be set as the flexible portion, and enabling a position of the driving rod 30 to be adjustably disposed, thereby it is guaranteed that the driving rod 30 drives at least part of the air sweeping blade 20 to move, so that air sweeping requirements in different orientations of the air sweeping mechanism are guaranteed.

In order to guarantee rapid formation of the driving rod 30 and the air sweeping blade 20, in an embodiment, the driving rod 30 and the air sweeping blade 20 are integrally injection-formed.

In order to further improve the assembly efficiency of the air sweeping mechanism, in an embodiment, the mounting portion 10, the air sweeping blade 20 and the driving rod 30 are integrally formed.

In some embodiments, the mounting portion 10, the air sweeping blade 20 and the driving rod 30 are integrally injection-formed.

Figure 5:
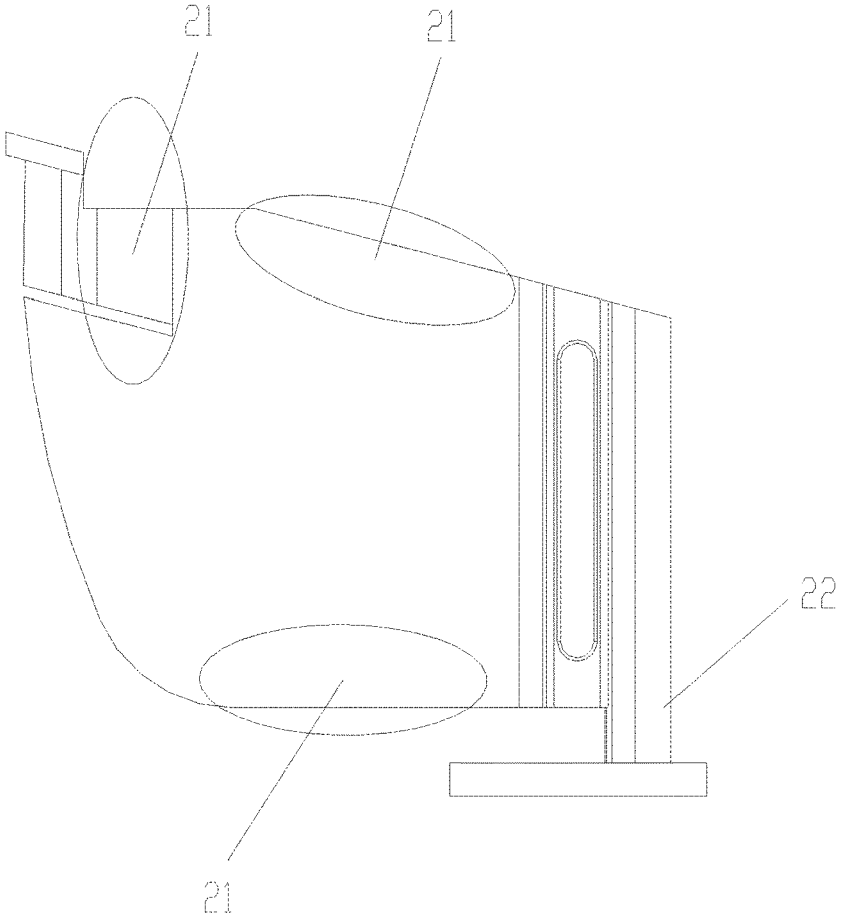
FIG. 5 illustrates a local structure schematic diagram of air sweeping blade of the air sweeping mechanism according to the disclosure.

In allusion to a specific connecting mode in which the air sweeping blade 20 is connected with the driving rod 30, as shown in FIG. 2 and FIG. 5, the air sweeping blades 20 includes a first connecting portion 21, the first connecting portion 21 is connected with the driving rod 30, and the first connecting portion 21 is a flexible portion.

In some embodiments, through installing the first connecting portion 21 on the air sweeping blades 20, wherein, the first connecting portion 21 is connected with the driving rod 30, so that the air sweeping blade 20 is connected with the driving rod 30 through the first connecting portion 21.

In some embodiments, through enabling the first connecting portion 21 to be set as the flexible portion, thereby it is guaranteed that the first connecting portion 21 does not affect the driving rod 30 to drive at least part of the air sweeping blade 20 to move.

In some embodiments, the first connecting portion 21 is a flexible hinge.

In allusion to a specific position of the first connecting portion 21, a plurality of positions of the first connecting portion 21 as shown in FIG. 5, the first connecting portion 21 is positioned at one end, away from the mounting portion 10, of the air sweeping blades 20; or the first connecting portion 21 is positioned in a middle of the air sweeping blade 20.

In some embodiments, the first connecting portion 21 is positioned at one end, away from the mounting portion 10, of the air sweeping blades 20, namely, positioned at a top end of the air sweeping blade 20.

In some embodiments, the first connecting portion 21 is positioned in the middle of the air sweeping blades 20, namely, positioned between the bottom end and the top end of the air sweeping blade 20.

In some embodiments, in order to achieve the connection of the air sweeping blades 20 and the mounting portion 10, as shown in FIG. 2, each of the air sweeping blades 20 includes a second connecting portion 22, the second connecting portion 22 is connected with the mounting portion 10, at least part, close to the second connecting portion 22, of the air sweeping blade 20 is a flexible portion, so that the air sweeping blade 20 is moveably disposed relative to the mounting portion 10.

In some embodiments, through installing the second connecting portion 22 on the air sweeping blade 20, wherein, the second connecting portion 22 is connected with the mounting portion 10, so that each of the air sweeping blades 20 is connected with the mounting portion 10 through the second connecting portion 22.

In some embodiments, in order to guarantee that the air sweeping blade 20 is moved under the driving of the driving rod 30, at least part, close to the second connecting portion 22, of the air sweeping blade 20 is a flexible portion, thereby under the driving of the driving rod 30, the flexible portion of the air sweeping blade 20 is deformed, so that the air sweeping blade 20 is moveably disposed relative to the mounting portion 10.

In some embodiments, at least part, close to the second connecting portion 22, of each of the air sweeping blades 20 is a flexible hinge.

Figure 3:
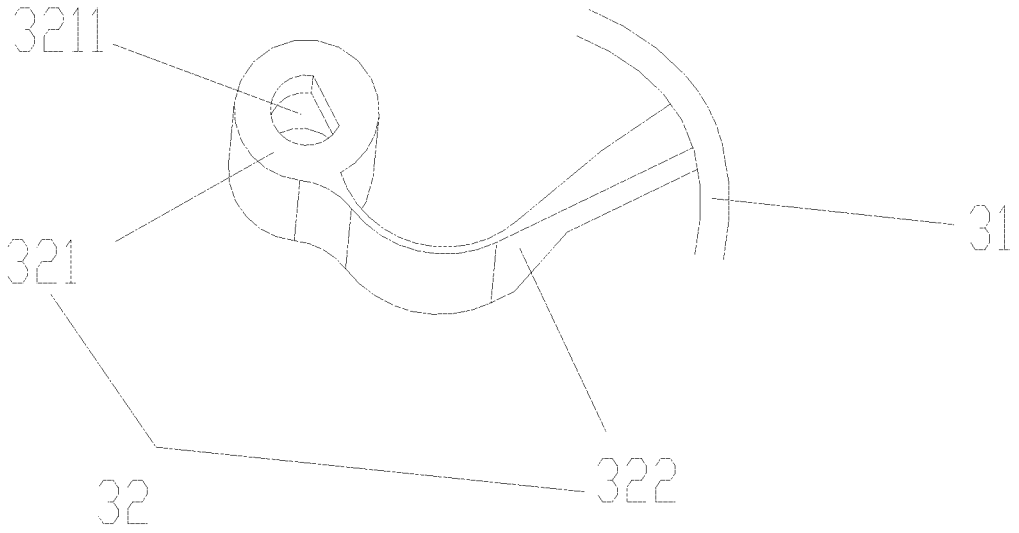
FIG. 3 illustrates a structure schematic diagram of a first embodiment of a driving portion of the air sweeping mechanism according to the disclosure.
Figure 4:
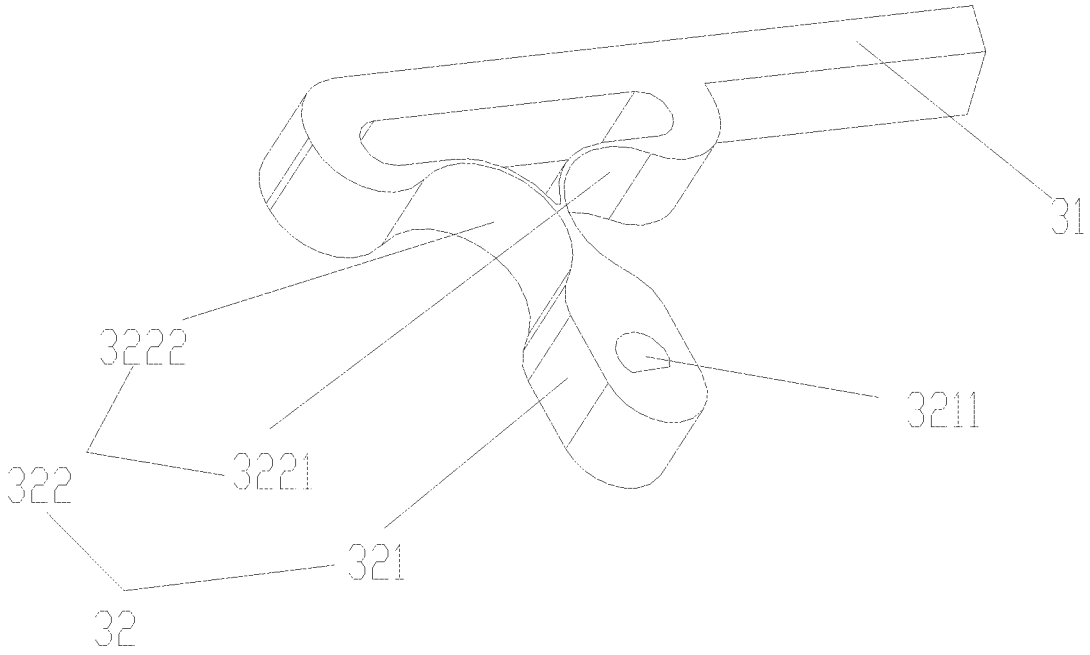
FIG. 4 illustrates a structure schematic diagram of a second embodiment of the driving portion of the air sweeping mechanism according to the disclosure.

In an embodiment of the present disclosure, as shown in FIG. 3 and FIG. 4, the driving rod 30 includes a fixing portion 31, the fixing portion 31 is connected with the air sweeping blades 20, at least part of the fixing portion 31 is extended along a length direction of the mounting portion 10; and a driving portion 32, the driving portion 32 is connected with one end of the fixing portion 31, and a position of the driving portion 32 is adjustably disposed, so as to drive the fixing portion 31 to move.

In some embodiments, the driving rod 30 includes the fixing portion 31 and the driving portion 32, wherein, the fixing portion 31 is connected with the air sweeping blades 20, at least part of the fixing portion 31 is extended along the length direction of the mounting portion 10, and the driving portion 32 is connected with one end of the fixing portion 31.

In some embodiments, the position of the driving portion 32 is adjustably disposed, so that the air sweeping blade 20 is driven to be moved by driving the fixing portion 31.

In allusion to a specific structure of the driving portion 32, as shown in FIG. 3 and FIG. 4, the driving portion 32 includes a first driving section 321 and a second driving section 322, the first driving section 321 is provided with a passing hole 3211, the passing hole 3211 is configured to be connected with a rotation shaft of a driving motor 40; a first end of the second driving section 322 is connected with the first driving section 321, and a second end of the second driving section 322 is connected with the fixing portion 31, wherein, at least part of the second driving section 322 is a flexible portion.

In some embodiments, the driving portion 32 is formed by the first driving section 321 and the second driving section 322, wherein, the first driving section 321 is provided with the passing hole 3211, the passing hole 3211 is configured to be connected with a rotation shaft of the driving motor 40, the first end of the second driving section 322 is connected with the first driving section 321, and the second end of the second driving section 322 is connected with the fixing portion 31.

In some embodiments, through enabling at least part of the second driving section 322 to be set as the flexible portion, thereby under the driving of the rotation shaft of the driving motor 40, at least part of the second driving section 322 is bended to be deformed, so as to drive the fixing portion 31 to move.

In the embodiment, the fixing portion 31 and the driving portion 32 are integrally formed.

In allusion to a first embodiment of the driving portion 32, as shown in FIG. 3, the second driving section 322 is a flexible hinge.

In allusion to a second embodiment of the driving portion 32, as shown in FIG. 4, the second driving section 322 includes: a first stretching section 3221 and a second stretching section 3222, a first end of the first stretching section 3221 is connected with the first driving section 321, and a second end of the first stretching section 3221 is connected with the fixing portion 31; a first end of the second stretching section 3222 is connected with the first driving section 321, and a second end of the second stretching section 3222 is connected with the fixing portion 31, wherein, at least part of the first stretching section 3221 is a flexible portion, and at least part of the second stretching section 3222 is a flexible portion.

In some embodiments, the second driving section 322 is formed by the first stretching section 3221 and the second stretching section 3222, wherein the first end of the first stretching section 3221 is connected with the first driving section 321, the second end of the first stretching section 3221 is connected with the fixing portion 31, the first end of the second stretching section 3222 is connected with the first driving section 321, and the second end of the second stretching section 3222 is connected with the fixing portion 31.

In some embodiments, through enabling at least part of the first stretching section 3221 to be set as the flexible portion, and enabling at least part of the second stretching section 3222 to be set as the flexible portion, under the driving of the rotation shaft of the driving motor 40, at least part of the second driving section 322 is bended to be deformed, so as to drive the fixing portion 31 to move.

In some embodiments, the second end of the first stretching section 3221 and the second end of the second stretching section 3222 are spaced from each other, and an avoidance cavity is formed between the first stretching section 3221, the second stretching section 3222, the fixing portion 31 and the first driving section 321.

In some embodiments, while the rotation shaft of the driving motor 40 drives the first driving section 321 to be rotated, the first stretching section 3221 and the second stretching section 3222 are in a full-stretching state, thereby the excessive stress effect is not generated to the first stretching section 3221 and the second stretching section 3222, so as to guarantee the stable operation of the air sweeping mechanism.

In some embodiments, the air sweeping mechanism further includes: the driving motor 40.

In some embodiments, the rotation shaft of the driving motor 40 is clockwise and counterclockwise rotated, wherein, a clockwise angle and a counterclockwise angle are less than or equal to 90 degrees.

Some embodiments of the present disclosure further provides an air conditioner, as shown in FIG. 6, the air conditioner includes an air sweeping mechanism, the air sweeping mechanism is the above air sweeping mechanism.

As is seen from the above description, the above embodiments of the disclosure implement the following technical effects.

The air sweeping mechanism of the disclosure is disposed through enabling the air sweeping blade 20 and the driving rod 30 to be integrally formed, in a specific assembling process, the air sweeping blade 20 is connected with the mounting portion 10, and then the mounting portion 10 is installed on a housing 50 of the air conditioner, so that the installation of the air sweeping mechanism is completed. The air sweeping mechanism of the disclosure is disposed through enabling the air sweeping blade 20 and the driving rod 30 to be integrally formed, installing steps of the air sweeping blade 20 and the driving rod 30 are eliminated, and the assembly efficiency of the air sweeping mechanism is improved in a certain degree, thereby the problem in the art known to inventors that the assembly efficiency of the air sweeping mechanism is lower is solved.

It should be noted that, terminologies such as "first" and "second" in the specification, claims and accompanying drawings of the disclosure are only used to distinguish similar objects, rather than to describe a special order or a precedence order. It should be understood that data used in such a way may be interchangeable in a certain case, such that the embodiments of the disclosure described here may be implemented in an order other than those illustrated or described here. In addition, the terms "comprise," "comprising," "include," "including," "has," "having" or any other variation thereof, are intended to cover a non-exclusive inclusion. For example, a process, method, system, product or device that includes a list of steps or units is not necessarily limited only to those steps or units but may include other steps or units not expressly listed or inherent to such process, method, product or device.

For ease of description, spatial relative terms such as "over", "above", "on an upper surface" and "upper" are used herein for describing a spatial position relation between a device or feature and other devices or features shown in the drawings. It will be appreciated that the spatial relative terms aim to contain different orientations in usage or operation besides the orientations of the devices described in the drawings. For example, if the devices in the drawings are inverted, devices described as "above other devices or structures" or "over other devices or structures" will be located as "below other devices or structures" or "under other devices or structures". Thus, an exemplar term "above" includes two orientations namely "above" and "below". The device may also be located in other different modes (rotated by 90 degrees or located in other orientations), and spatial relative descriptions used herein are correspondingly explained.

The above are only some embodiments of the disclosure, and are not intended to limit the disclosure. As will occur to those skilled in the art, the disclosure is susceptible to various modifications and changes. Any modification, equivalent replacement, improvement and the like made within a spirit and a principle of the disclosure should be included in a protection scope of the disclosure.

What is claimed is:

1. An air sweeping mechanism, comprising:

a mounting portion, the mounting portion being configured to be mounted on a housing of an air conditioner;

an air sweeping blade, the air sweeping blade being connected with the mounting portion; and a driving rod, the driving rod being connected with the air sweeping blade, and a position of the driving rod being adjustably disposed, wherein the air sweeping blade and the driving rod are integrally formed, at least part of the air sweeping blade is a flexible part, and the driving rod drives the at least part of the air sweeping blade to move; wherein the air sweeping blade comprises a first connecting portion, the first connecting portion is connected with the driving rod, and the first connecting portion is a flexible part;

wherein the air sweeping blade comprises a second connecting portion, the second connecting portion is connected with the mounting portion, at least part, close to the second connecting portion, of the air sweeping blade is a flexible part, so that the air sweeping blade is moveably disposed relative to the mounting portion;

wherein the driving rod comprises:

a fixing portion, the fixing portion being connected with the air sweeping blade; and a driving portion, the driving portion being connected with one end of the fixing portion, and a position of the driving portion being adjustably disposed, so as to drive the fixing portion to move;

wherein the driving portion comprises:

a first driving section; and a second driving section, a first end of the second driving section being connected with the first driving section, and a second end of the second driving section being connected with the fixing portion; wherein at least part of the second driving section is a flexible part;

wherein the second driving section comprises:

a first stretching section, a first end of the first stretching section being connected with the first driving section, and a second end of the first stretching section being connected with the fixing portion; and a second stretching section, a first end of the second stretching section being connected with the first driving section, and a second end of the second stretching section being connected with the fixing portion, wherein at least part of the first stretching section is a flexible part, and at least part of the second stretching section is a flexible part;

wherein the second end of the first stretching section and the second end of the second stretching section are spaced from each other, and an avoidance cavity is formed between the first stretching section, the second stretching section, the fixing portion and the first driving section, while the rotation shaft of the driving motor drives the first driving section to be rotated, the first stretching section and the second stretching section are in a full-stretching state, the first connecting portion is positioned in a middle of the air sweeping blade.

2. The air sweeping mechanism as claimed in claim 1, wherein the driving rod and the air sweeping blade are integrally injection-formed.

3. The air sweeping mechanism as claimed in claim 1, wherein the mounting portion, the air sweeping blade and the driving rod are integrally formed.

4. The air sweeping mechanism as claimed in claim 3, wherein the mounting portion, the air sweeping blade and the driving rod are integrally injection-formed.

5. The air sweeping mechanism as claimed in claim 1, wherein the first connecting portion is a flexible hinge.

6. The air sweeping mechanism as claimed in claim 1, wherein at least part, close to the second connecting portion, of the air sweeping blade is a flexible hinge.

7. The air sweeping mechanism as claimed in claim 6, the first driving section being provided with a passing hole, the passing hole being configured to be connected with a rotation shaft of a driving motor.

8. The air sweeping mechanism as claimed in claim 7, wherein the second driving section is a flexible hinge.

9. The air sweeping mechanism as claimed in claim 1, at least part of the fixing portion being extended along a length direction of the mounting portion; the length direction is a direction of the long side of the mounting portion.

10. The air sweeping mechanism as claimed in claim 1, wherein the rotation shaft of the driving motor is clockwise and counterclockwise rotated, wherein, a clockwise angle and a counterclockwise angle are less than or equal to 90 degrees.

11. An air conditioner, comprising an air sweeping mechanism, wherein the air sweeping mechanism is the air sweeping mechanism as claimed in claim 1.

12. The air conditioner as claimed in claim 11, wherein the driving rod and the air sweeping blade are integrally injection-formed.

13. The air conditioner as claimed in claim 11, wherein the mounting portion, the air sweeping blade and the driving rod are integrally formed.

14. The air conditioner as claimed in claim 13, wherein the mounting portion, the air sweeping blade and the driving rod are integrally injection-formed.

15. The air conditioner as claimed in claim 11, wherein the air sweeping blade comprises a first connecting portion, the first connecting portion is connected with the driving rod, and the first connecting portion is a flexible part.

* * * * *